US008756846B1

(12) United States Patent
Lemoine

(10) Patent No.: US 8,756,846 B1
(45) Date of Patent: Jun. 24, 2014

(54) SHOTGUN MAGAZINE RECEIVER ASSEMBLY

(71) Applicant: Eric Lemoine, Winter Garden, FL (US)

(72) Inventor: Eric Lemoine, Winter Garden, FL (US)

( * ) Notice: Subject to any disclaimer, the term of this patent is extended or adjusted under 35 U.S.C. 154(b) by 0 days.

(21) Appl. No.: 13/736,113

(22) Filed: Jan. 8, 2013

(51) Int. Cl.
*F41A 19/06* (2006.01)

(52) U.S. Cl.
USPC ..... 42/69.01

(58) Field of Classification Search
USPC ..... 42/69.01, 69.02
See application file for complete search history.

(56) References Cited

U.S. PATENT DOCUMENTS 1,096,615 A * 5/1914 Febiger ..... 89/144
2,675,638 A * 4/1954 Crittendon ..... 42/69.01
5,054,221 A 10/1991 Ozols
5,771,620 A 6/1998 Crawford et al.
2006/0048426 A1* 3/2006 Crandall ..... 42/69.01
2007/0245615 A1* 10/2007 Karagias ..... 42/69.02
2010/0263527 A1* 10/2010 Darian ..... 89/191.01
2011/0154709 A1* 6/2011 Rotharmel et al. ..... 42/69.01
2012/0066950 A1 3/2012 Davidson

* cited by examiner

*Primary Examiner* — Bret Hayes

(74) *Attorney, Agent, or Firm* — Jason T. Daniel, Esq.; Daniel Law Offices, P.A.

(57) ABSTRACT

A shotgun magazine receiver assembly includes an elongated receiver body having a trigger assembly opening, a removable magazine opening, a shotgun barrel opening, a shell ramp and a bolt and slide. The bolt and slide are positioned to align with the center of the barrel opening and to engage a removable box-style shotgun shell magazine. A shotgun magazine receiver assembly also includes a plurality of connectors to secure the assembly to a stock barrel, grip, trigger assembly, and magazine tube of a conventional shotgun.

12 Claims, 9 Drawing Sheets

SHOTGUN MAGAZINE RECEIVER ASSEMBLY

TECHNICAL FIELD

The present invention relates generally to shotguns and, more particularly to a retrofit magazine receiver for use with a conventional shotgun.

BACKGROUND

The statements in this section merely provide background information related to the present disclosure and may not constitute prior art.

FIGS. 1 and 2 illustrate one embodiment of a conventional pump-action shotgun that is useful for understanding the inventive concepts disclosed herein. As shown, the conventional shotgun 1 typically includes an elongated fixed magazine tube 2 that is mounted below the gun barrel 3. The tube and barrel are secured to a receiver 4 that houses a trigger assembly 5, a bolt 6 and a bolt slide 7. A grip 8 and forearm handle 9 are also provided.

The fixed magazine tube holds about five shells or cartridges (not illustrated) which are loaded individually into the magazine via the shell opening 4*a*. After firing each round, the user must pump the forearm 9 to chamber the next round into the receiver 4 for firing. After all of the shells are fired, the next round of shells are loaded one at a time into the fixed tubular magazine, and the above process is repeated.

Although rapid firing and reloading capabilities have been achieved with some small firearms, such as assault rifles and pistols, they have not yet been satisfactorily achieved with shotguns.

Moreover, many firearm owners routinely modify their weapons to suit a particular interest, look, or to accomplish a desired function. Owing to the extremely durable nature of shotguns in particular, many shotgun owners often choose to upgrade their existing weapons with new stocks and barrels as opposed to purchasing a new weapon. Accordingly, it would be beneficial to provide a shotgun magazine receiver assembly which can replace the stock receiver of an existing shotgun to allow a user to rapidly fire and reload ammunition via a removable "box" style magazine. Such a feature would be particularly beneficial for police and military applications, where the time necessary to reload a weapon can mean the difference between life and death.

SUMMARY OF THE INVENTION

The present invention is directed to a shotgun magazine receiver assembly. One embodiment of the present invention can include a receiver body capable of replacing a stock receiver body of a conventional shotgun. The assembly includes a bolt and slide which act to mate with the stock shotgun components in order to engage and fire cartridges supplied from a box-style removable magazine.

As the present invention is designed to be incorporated into existing shotguns, the main body can include a plurality of connectors for engaging the stock barrel, grip, trigger assembly, and magazine tube.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
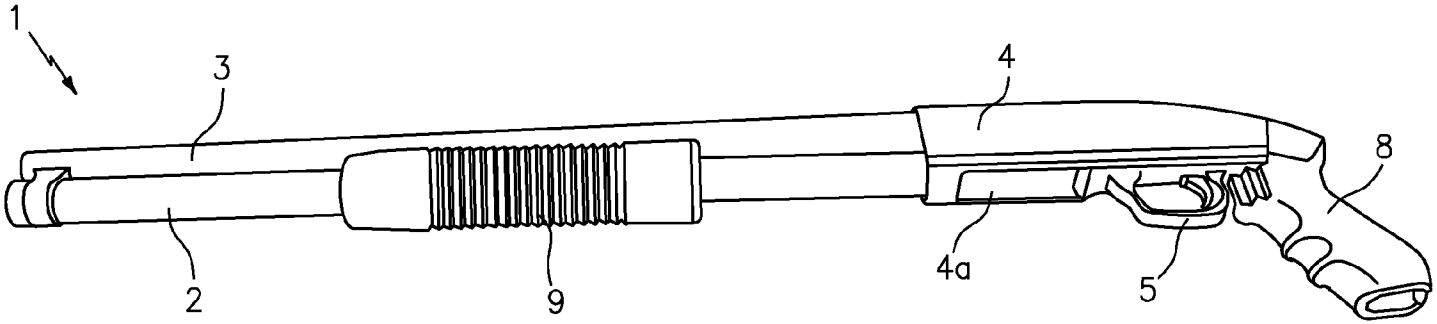
FIG. 1 (Background Art)
FIG. 1 is a side view of a shotgun in accordance with background art.
Figure 2:
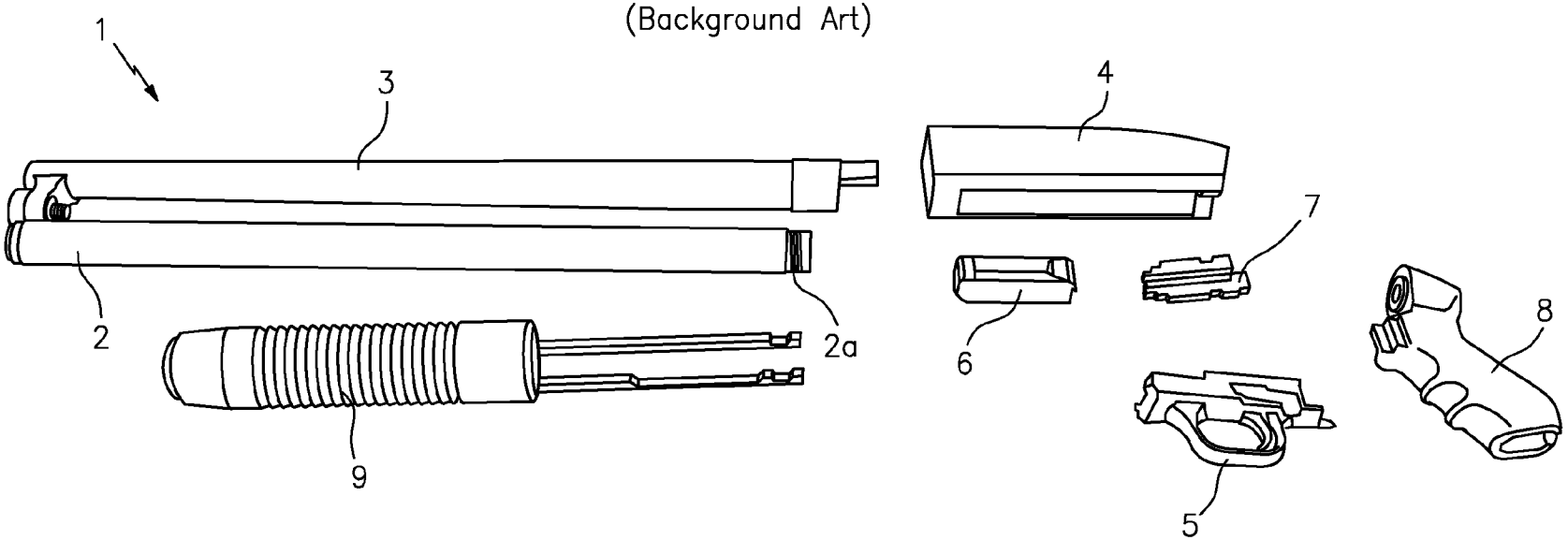
FIG. 2 (Background Art)
FIG. 2 is an exploded parts view of a shotgun in accordance with background art.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 7.

As described herein, the term "shotgun" can refer to virtually any type and manufacturer of semi-automatic and/or shotguns. As will be described below, the present invention includes a shotgun magazine receiver assembly which can act as a retrofit kit for existing shotguns. Although illustrated in use with a MOSSBERG 500 shotgun, it is to be distinctly understood that the present invention has broader applications, and is equally applicable for use on many other shotguns without undue experimentation and without departing from the invention claimed. Several non-limiting examples include the MOSSBERG 590, MAVERICK 88, REMINGTON 870, REMINGTON 1100, MOSSBERG 930, BENELLI M4, and the WINCHESTER 1300, for example. Accordingly, the presently claimed invention is not to be construed as limiting. Additionally, it is noted that several stock shotgun components are omitted from the illustrations for the sake of clarity. The basic operation of a shotgun, and the various firing components necessary for performing the same are well known in the art, and are not repeated herein.

In one preferred embodiment, the term "removable magazine" can refer to the SAIGA 12 box-style magazine commercially available from SAIGA. However, it is to be distinctly understood that the present invention has broader applications, and is equally applicable for use with any number of other commercially available shotgun magazines without undue experimentation and without departing from the invention claimed. One non-limiting example of a suitable removable magazine which can be utilized in conjunction with the shotgun magazine receiver assembly is described in U.S. Patent Publication No. 2012-0066950, to Davidson, the contents of which are incorporated herein by reference.

FIGS. 3-8 illustrate various components and embodiments of a shotgun magazine receiver assembly that is useful for understanding the inventive concepts disclosed herein. The device assembly 10 can function to replace the traditional receiver 4, bolt 6 and slide 7 of a conventional shotgun 1 and to mate with all other factory supplied components so as to enable the conventional shotgun to utilize a box-style removable magazine.

Figure 3A:
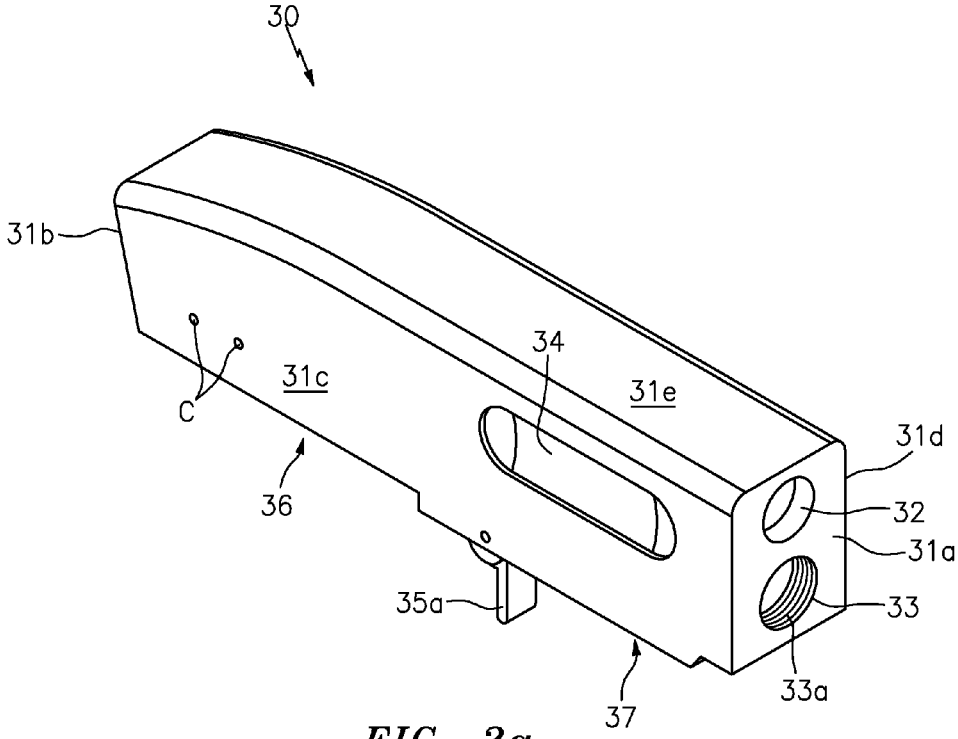
FIG. 3*a* is a side view of the receiver body of the assembly in accordance with one embodiment of the invention.
Figure 3D:
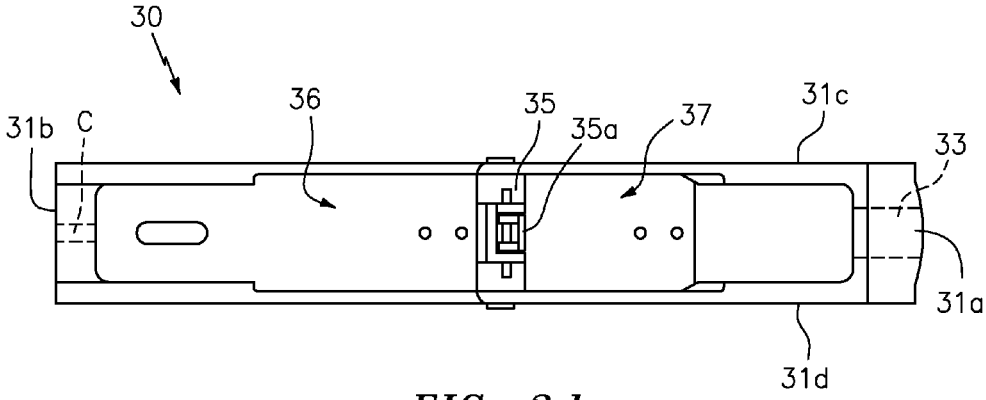
FIG. 3*d* is a bottom side view of the receiver body of the assembly in accordance with one embodiment of the invention.

The receiver body 30 can function to replace the stock receiver of a shotgun to which the assembly will be installed. As shown in FIGS. 3*a*, 3*c* and 3*d*, the receiver body 30 can include an elongated generally hollow member having a front end 31*a*, a back end 31*b*, and a pair of opposing, generally parallel side walls 31*c* and 31*d* that are joined together by a top wall 31*e*.

Any number of connectors C such as through holes and/or threaded openings, for example, can be disposed along the receiver body at locations identical to those found on the stock receiver 4 in which the new receiver body 30 is replacing. These connectors C acting to allow the receiver body 30 to mate with the complementary connectors C' located on the stock grip 8, trigger assembly 5 and other components (See FIG. 7) in a traditional manner utilizing conventional manufacture supplied hardware such as screws and bolts, for example.

A pair of circular openings 32 and 33 are disposed along the front end of the receiver body. The openings 32 and 33 including a dimension suitable for receiving the stock barrel 3 and tube magazine 2, respectively of the shotgun 1 to which the assembly is being secured. Opening 33 can further include a plurality of threaded elements 33*a* corresponding to the threads 2*a* on the magazine tube, so as to allow the magazine tube to be secured onto the new assembly 30 via a twisting motion.

An ejector port 34 is disposed along one of the opposing side walls 31*c*. As will be described below, the ejector port 34 includes a location on the receiver body, and a dimension suitable to allow spent cartridges 71 to be ejected from the bolt 41 in a conventional manner.

Figure 3B:
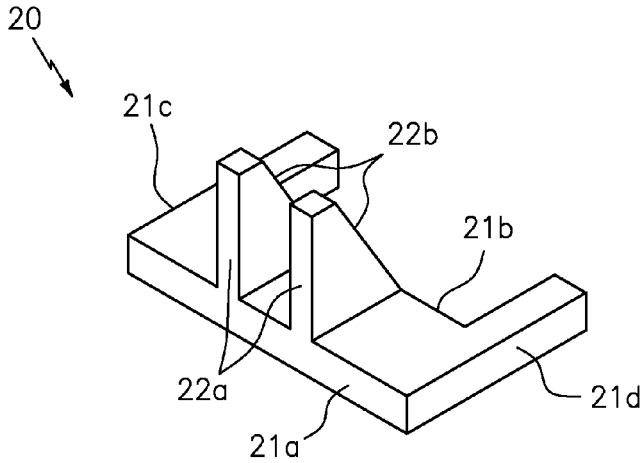
FIG. 3*b* is a perspective view of a shell ramp of the assembly in accordance with one embodiment of the invention.
Figure 3C:
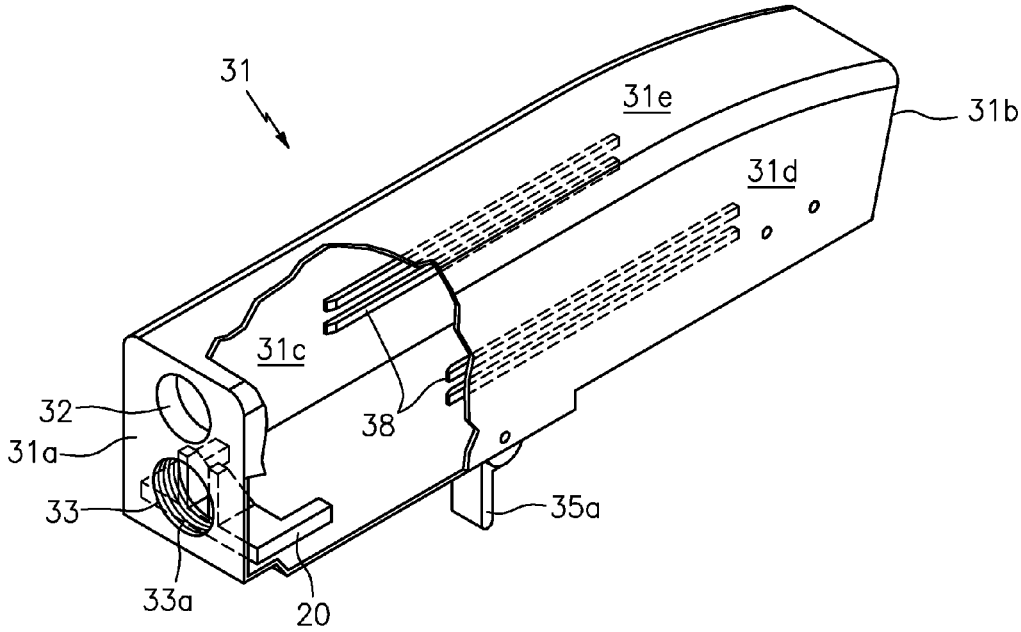
FIG. 3*c* is a side elevation view of the receiver body with portions broken away in accordance with one embodiment of the invention.

FIG. 3*b* illustrates a shell ramp 20 that includes a generally U-shaped flat member having a forward facing surface 21*a*, a rear facing surface 21*b*, and a pair of opposing side surfaces 21*c* and 21*d*. Surfaces 21*a*, 21*c* and 21*d* including a dimension suitable for being secured within the receiver body at a location abutting receiver body segments 31*a*, 31*c* and 31*d*, respectively. The shell ramp 20 also including a pair of spaced vertical ramps, each having a flat forward surface 22*a* and an angled rear surface 22*b*.

As shown in FIG. 3*c*, the ramp 20 can be positioned within the receiver body to ensure the uppermost portion of the vertical protrusions are aligned with the lowermost portion of the shotgun barrel opening 32. Such a feature can allow the device 20 to act as a guide for the final shell in a magazine to ensure that the last shell slides into the barrel properly.

A pair of elongated generally parallel channels 38 can be formed along the inside portion of each of the receiver side walls 31*c* and 31*d*. As will be described below, each of the channels 38 can include a dimension suitable for receiving the slide guides 53 of the slide mechanism in order to allow the slide to function in a controlled and linear manner.

As shown best in FIG. 3*d*, the bottom side of the receiver main body 31 includes an open construction so as to allow access to the generally hollow interior space defined by the top and side walls. A bracket 35 is cross mounted between the lowermost edges of the opposing side walls 31*c* and 31*d* and functions to segment the hollow space into a pair of separate openings identified as a trigger assembly opening 36 and a magazine opening 37.

The trigger assembly opening 36 can act to receive the stock trigger assembly 5 for use with the present invention. To this end, the trigger assembly opening 36 can include any number of ridges and grooves within the inside facing portion of side walls 31*c* and 31*d* to form a shape and dimension that is complementary to the physical shape and dimension of the stock shotgun trigger assembly 5.

The magazine opening 37 (i.e., magwell) can act to receive a removable magazine 70 (see FIG. 7) that can be positioned so as to communicate with the bolt 40 and slide 50 described below. To this end, the magazine opening 37 can also include any number of ridges and grooves within the inside facing portion of side walls 31*c* and 31*d* to form a shape and dimension that is complementary to the physical shape and dimension of the removable magazine 70. Additionally, the bracket 35 can further include a spring mounted pivotally actuated latch 35*a* which can act to receive and lock the upper lip of the removable magazine into the magazine opening 37.

The below described bolt 40 and slide 50 can function together to receive a shell/cartridge 71 from an inserted removable magazine 70, and to position the same within the stock shotgun barrel 3 for firing.

Figure 4B:
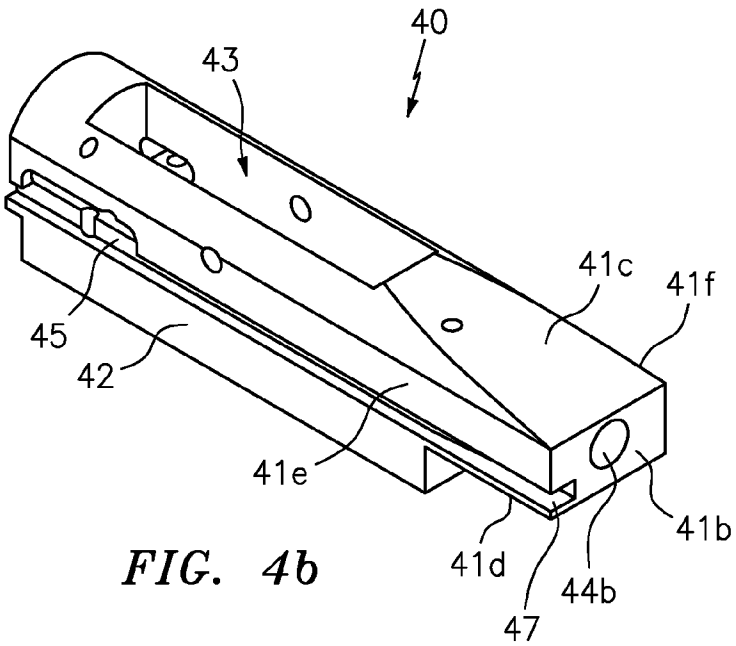
FIG. 4*b* is another perspective view of the bolt of the assembly in accordance with one embodiment of the invention.
Figure 4A:
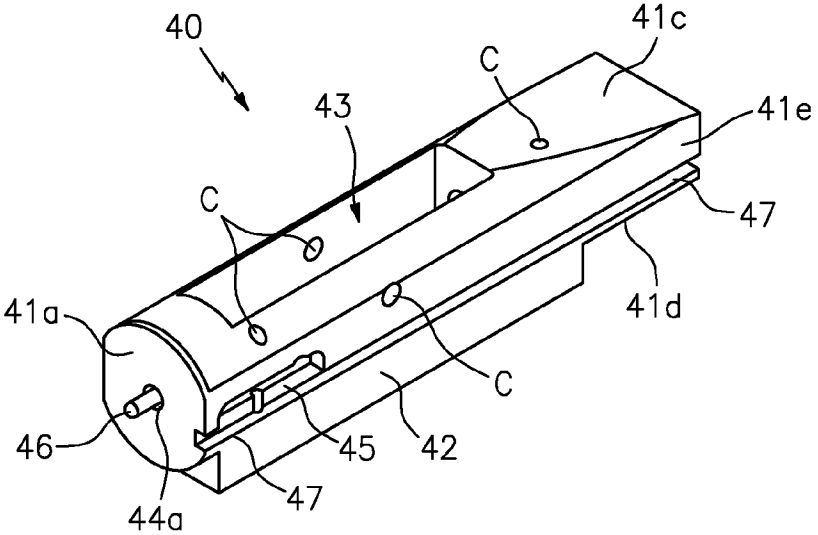
FIG. 4*a* is a perspective view of the bolt of the assembly in accordance with one embodiment of the invention.

FIGS. 4*a* and 4*b* illustrate one embodiment of the bolt 40 that can be included in the shotgun magazine receiver assembly 10. As shown, the bolt can include a main body having a front wall 41*a*, a rear wall 41*b*, a top surface 41*c*, a bottom surface 41*d* and a pair of opposing side walls 41*e* and 41*f*, each defining an elongated chamber for housing a firing pin 46. A generally rectangular shaped protrusion 42 is formed along a portion of the bottom surface 41*d* of the bolt. The protrusion having a length that is less than the distance between the front wall 41*a* and the rear wall 41*b* so as to allow each of the front and rear walls to extend outward therefrom in a longitudinal manner.

An opening 43 extends from the top surface 41*c* through the bottom surface 41*d* for accessing the firing pin and the lock stop of the receiver. As shown, each of the front and rear walls 41*a* and 41*b* also include openings 44*a* and 44*b*, respectively. Opening 44*b* being used to receive the firing pin 46, and opening 44*a* being used to allow the end of the firing pin 46 to make contact with a shotgun cartridge.

Each side of the bolt main body 41*e* and 41*f* can further include an extractor arm recess 45 located adjacent to the front wall 41*a*. Additionally, side wall 41*e* can further include an elongated spring groove 47 that extends from the front wall 41*a* to the rear wall 41*b*. The extractor arm recesses 45 and spring groove 47 providing a connection point with the manufacturer supplied extractor arms and spring (not shown), respectively, of the shotgun 1.

Figure 5:
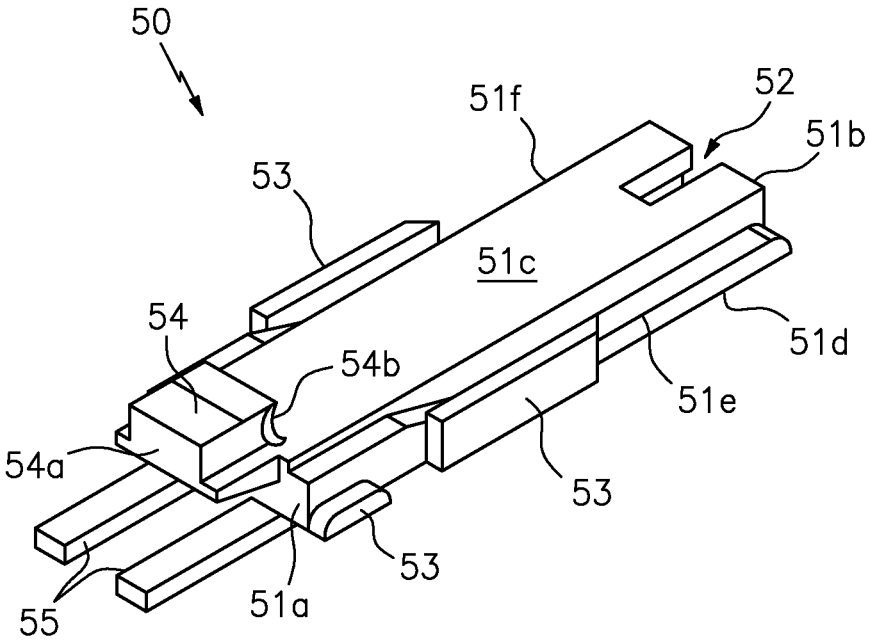
FIG. 5 is a perspective view of the slide of the assembly in accordance with one embodiment of the invention.

FIG. 5 illustrates one embodiment of the slide 50 that can be included in the shotgun magazine receiver assembly 10.

The slide 50 can include an elongated member having a front wall 51*a*, a rear wall 51*b*, a generally flat top surface 51*c*, a bottom surface 51*d* and a pair of opposing side walls 51*e* and 51*f*. A trigger assembly indentation 52 is provided along the rear wall 51*b* to accommodate the stock hammer and trigger assembly 5 in order to allow the bolt and slide to function in a conventional manner.

One or more elongated protruding slide guides 53 can be disposed on each of the side surfaces 51*e* and 51*f*. Each of the guides 53 can be secured within the slide channel 38 of the receiver body 30, in order to allow the slide to move in a straight, controlled and linear fashion.

An upward radiating lock stop 54 is positioned along the top surface 51*c* of the slide. The lock stop includes a dimension suitable for being housed within the opening 43 of the bolt and further includes a first end 54*a* that extends beyond the front wall 51*a* of the slide. The second end 54*b* of the lock stop includes a curved surface that functions to interact with the factory supplied shotgun lock (not shown).

A pair of generally parallel fingers 55 extend longitudinally from the front wall of the slide 51*a*. Upon movement of the slide, each of the shafts makes contact with the back side of a shell and removes the same from a removable magazine that is secured within the receiver body 30.

As described herein, each of the receiver body 30, bolt 40 and slide 50 can preferably be constructed from a durable metallic material such as steel, for example, capable of withstanding the rigors of repeated use with shotgun shells. Of course, any number of other suitable and conventional materials can also be utilized.

Figure 6A:
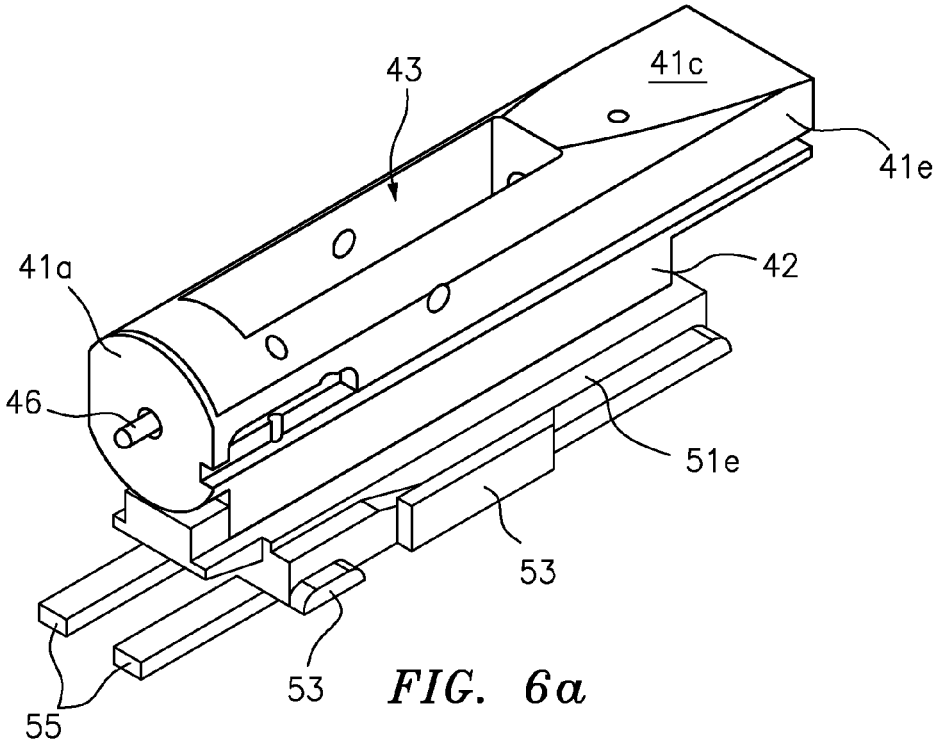
FIG. 6*a* is a perspective view of the assembled bolt and slide of the assembly in accordance with one embodiment of the invention.
Figure 6B:
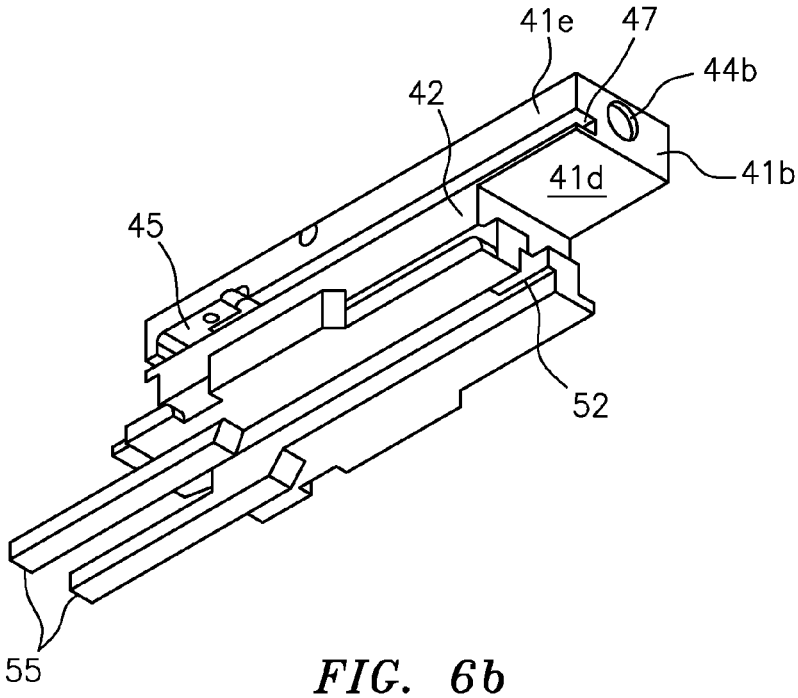
FIG. 6*b* is a side view of the assembled bolt and slide of the assembly in accordance with one embodiment of the invention.

FIGS. 6*a* and 6*b* illustrate one embodiment wherein the bolt 40 and slide 50 are joined. As shown, the bottom surface of the bolt 41*d* can be positioned above the upper surface of the slide 51*c*, and the bolt can be lowered onto the slide. When so positioned, the lock stop 54 will be located within the opening 43.

Figure 7:
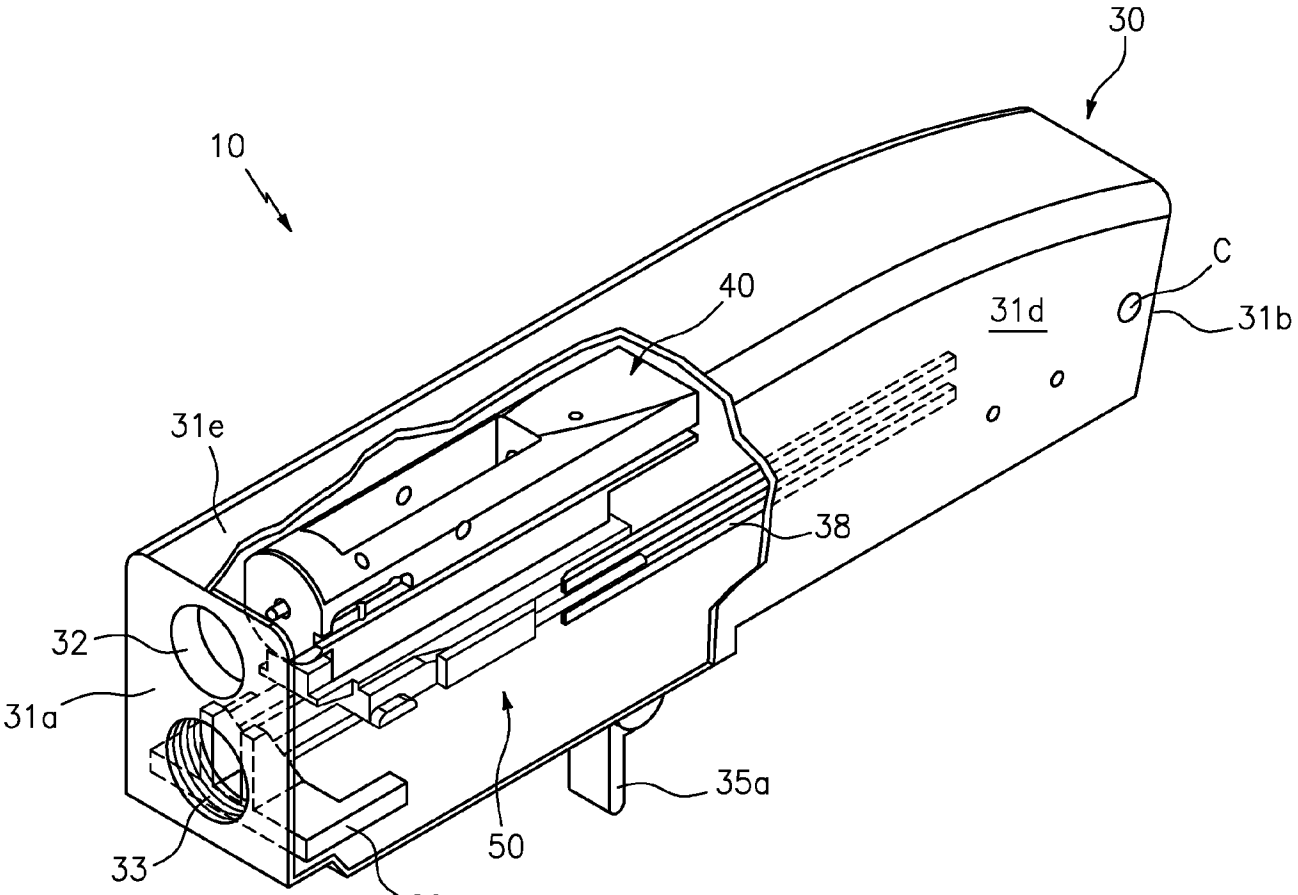
FIG. 7 is a side elevation view of the shotgun magazine receiver assembly with portions broken away in accordance with one embodiment of the invention.

FIG. 7 illustrates one non-limiting embodiment of the shotgun receiver assembly 10 wherein the bolt 40 and slide 50 are secured within the main receiver body 30 so as to align the bolt 40 and the firing pin 46 longitudinally with the center of the barrel opening 32. The slide 50 is positioned above the magazine opening 37 in order to allow the fingers 55 to remove shells from an inserted removable magazine.

Figure 8:
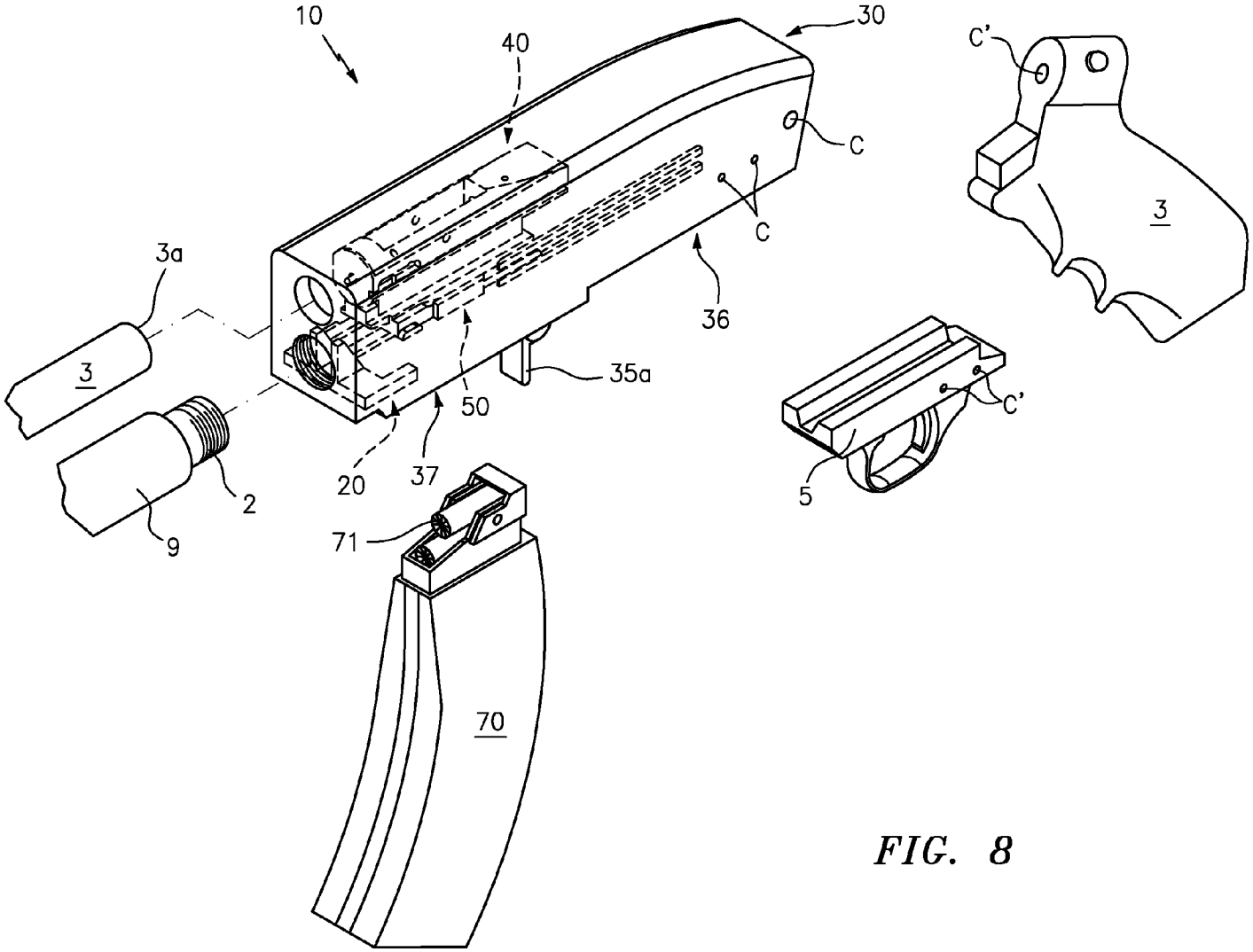
FIG. 8 is perspective view of the shotgun magazine receiver assembly in operation, with conventional shotgun components.
Figure 9:
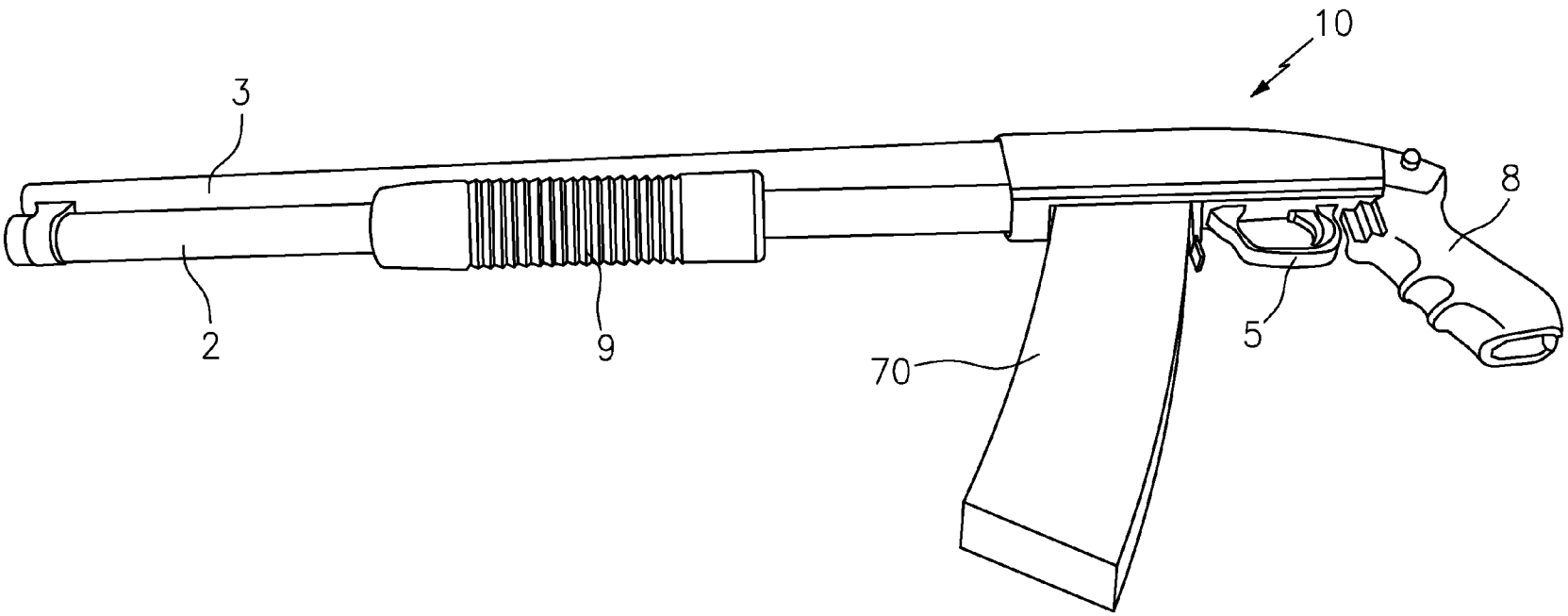
FIG. 9 is a side view of a shotgun employing the shotgun magazine receiver assembly, in accordance with one embodiment of the invention.

As shown in FIGS. 8 and 9, the shotgun receiver assembly 10 can be mated with all remaining stock components of the conventional shotgun necessary for proper operation, such as the handle 8, trigger assembly 5, shotgun barrel 3, tubular magazine 2 and the pump action handle 9, for example.

The following non-limiting example will illustrate the specific functionality of the shotgun magazine receiver assembly 10 in operation with the stock components of the conventional shotgun.

The stock shotgun handle 9 can act to open the bolt 40 so as to expose the interior of the receiver body. Although not illustrated, an optional charge handle can be provided to allow opening of the bolt when utilized with semi-automatic shotguns. Once the bolt is open, the removable magazine 70 can be inserted into the magwell 37 wherein the latch 35*a* captures the lip of the magazine. Push the pump handle forward to close the bolt 40. As the slide 50 pushes forward, it carries the bolt 40 with it to meet with the stock barrel 3. The fingers 55 on the slide 50 make contact with the next eligible round 71 in the magazine 70 by way of pushing on the top portion of the brass. The shell 71 slides out of the magazine, enabling the next shell to take its place. As a consequence, the shell pushed from the magazine is pushed vertically into alignment with the shotgun breech 3*a*. As the bolt 40 and slide 50 move forward to completion, the shell 71 is pushed into the breech 3*a* and the weapon is ready to fire.

As the trigger of the trigger assembly 5 is pulled, the trigger assembly hammer (not illustrated) is released and flies forward and strikes the firing pin 46. The firing pin 46 then extends from the front wall of the bolt 41*a*, makes contact with the shell charge and fires the shell. After the shell is fired, the pump handle 9 is manipulated back towards the receiver. (If semi auto, this is done automatically). The stock shotgun shell extractors (not shown) pinned to the bolt 40 will act to pull the spent shell casing towards the back wall of the receiver and out of the barrel breech 3*a*. As the bolt 40 slides backwards on the slide 50, the stock shotgun extractor spring snaps into position along the spring groove 47, thereby pushing the spent shell out through the receiver ejector port 34. Manipulate the pump handle forward and way from the receiver 30 to lead the next shell. (If the shotgun is semi auto, this is done automatically). If the next shell is the final shell in the magazine, the slide 50 pushes the shell out of the magazine as described above. The front portion of the shell slides up the last shell ramp 20 that is attached to the interior of the receiver and into the barrel breech 3*a*. In this way, the feed ramp 20 acts to align the shell to the breech opening of the barrel.

Accordingly, the shotgun magazine receiver assembly 10 functions to convert a conventional shotgun to accept and fire a box-style removable magazine in a novel manner.

As described herein, one or more elements of the shotgun magazine receiver assembly 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more of the individually identified elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A shotgun magazine receiver assembly for converting a conventional shotgun having a trigger assembly and barrel into a magazine loaded shotgun, said receiver assembly comprising:

an elongated receiver body having a front end, a back end, a top surface, a bottom surface, and a pair of opposing side surfaces defining an interior space, each of the opposing side surfaces including an elongated channel disposed along an inside portion thereof, and arranged in a generally parallel orientation to each other;

at least one connector disposed along the receiver body, said at least one connector having a location that is suitable for mating with a complementary connector disposed on the conventional shotgun;

a shotgun barrel opening disposed along the first end of the receiver body;

a trigger assembly opening disposed along the bottom side of the receiver body, each of the shotgun barrel opening, and trigger assembly opening including a dimension suitable for receiving a conventional shotgun barrel, and trigger assembly, respectively;

a magazine opening disposed along the bottom side of the receiver body at a location adjacent to the front end of the receiver body, said magazine opening being configured to receive a removable shotgun shell magazine;

a bolt having a front end, a rear end, a top surface, a bottom surface and a pair of side walls defining a firing pin chamber;

a firing pin disposed within the chamber;

a lock stop opening extending from the top surface of the bolt to the bottom surface of the bolt;

an extractor arm recess located along each side wall of the bolt and adjacent to the front wall; and a spring groove disposed along one of the side walls of the bolt, each of the extractor arm recesses and spring groove being configured to communicate with a conventional shotgun extractor arm and spring, respectively.

2. The shotgun magazine receiver assembly of claim 1, further comprising:

a shell ramp having an angled surface, said shell ramp being interposed between the barrel opening and the removable magazine opening along the front end of the receiver main body within the interior space, said shell ramp being configured to direct a shotgun shell from an inserted removable magazine into the shotgun barrel.

3. The shotgun magazine receiver assembly of claim 1, further comprising:

a slide having a front wall, a rear wall, a generally flat top surface and a pair of opposing side surfaces;

an indentation disposed along the rear wall, said indentation being configured to communicate with the conventional shotgun trigger assembly;

a pair of elongated slide guides disposed on the side surfaces, each of the guides being configured to slide within the elongated channels of the receiver main body;

a lock stop disposed along the top surface of the slide, said lock stop being configured to be positioned within the lock stop opening of the bolt; and a pair of elongated fingers configured to engage an inserted removable shotgun magazine, and to remove a shotgun shell therefrom.

4. The shotgun magazine receiver assembly of claim 3, wherein the bolt and slide are removably secured within the main receiver body so as to align the firing pin longitudinally with a center of the barrel opening, and the slide is positioned above the removable magazine opening.

5. The shotgun magazine receiver assembly of claim 4, wherein the bolt and slide are configured to engage the conventional trigger assembly, and an inserted removable shotgun magazine.

6. The shotgun magazine receiver assembly of claim 1, further comprising:

a spring actuated lever disposed along the bottom side of the receiver body at a location between the trigger assembly opening, and the removable magazine opening, said lever being configured to secure a removable magazine within the magazine opening.

7. The shotgun magazine receiver assembly of claim 1, further comprising:

a threaded tube magazine opening disposed along the first end of the receiver body, said tube magazine opening being positioned beneath the barrel opening and configured to receive a conventional shotgun tube magazine.

8. The shotgun magazine receiver assembly of claim 1, further comprising:

an ejector port disposed along one of the opposing side walls of the receiver body.

9. The shotgun magazine receiver assembly of claim 1, wherein the back end of the receiver body is configured to receive at least one of a conventional shotgun grip and a stock.

10. The shotgun magazine receiver assembly of claim 1, wherein a conventional shotgun comprises a pump action shotgun.

11. The shotgun magazine receiver assembly of claim 1, wherein a conventional shotgun comprises a semi-automatic shotgun.

12. The shotgun magazine receiver assembly of claim 1, further comprising:

a removable shotgun magazine.

* * * * *